US010889934B2

(12) United States Patent
Leibman et al.

(10) Patent No.: US 10,889,934 B2
(45) Date of Patent: Jan. 12, 2021

(54) REMOVABLE ADDITIVE CONTAINER FOR LAUNDRY APPLIANCES

(71) Applicant: Haier US Appliance Solutions, Inc., Wilmington, DE (US)

(72) Inventors: Alexander B. Leibman, Prospect, KY (US); Manidhar V V S Yandamuri, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 22 days.

(21) Appl. No.: 16/371,259

(22) Filed: Apr. 1, 2019

(65) Prior Publication Data

US 2020/0308755 A1 Oct. 1, 2020

(51) Int. Cl.

| | |
|---|---|
| ***F26B 7/00*** | (2006.01) |
| ***D06F 58/20*** | (2006.01) |
| ***D06F 39/02*** | (2006.01) |
| ***D06F 58/04*** | (2006.01) |
| ***D06F 39/12*** | (2006.01) |
| ***D06F 21/04*** | (2006.01) |

(52) U.S. Cl.

CPC ..... *D06F 58/203* (2013.01); *D06F 21/04* (2013.01); *D06F 39/022* (2013.01); *D06F 39/12* (2013.01); *D06F 58/04* (2013.01)

(58) Field of Classification Search

CPC ..... D06F 58/203; D06F 58/04; D06F 39/12; D06F 39/022; D06F 21/04

USPC ..... 34/389, 390, 380, 60

See application file for complete search history.

(56) References Cited

U.S. PATENT DOCUMENTS

| | | | | |
|---|---|---|---|---|
| 2,967,310 | A | 1/1961 | O'Hare | |
| 4,767,019 | A | 8/1988 | Horner | |
| 5,259,423 | A | 11/1993 | Simmel et al. | |
| 6,886,371 | B2 | 5/2005 | Aria et al. | |
| 7,100,790 | B2 | 9/2006 | Dark | |
| 7,168,589 | B2 | 1/2007 | Dark | |
| 8,887,536 | B2 * | 11/2014 | Kim | D06F 58/203 68/17 R |
| 2006/0037962 | A1 | 2/2006 | Kim | |
| 2006/0249521 | A1 | 11/2006 | Dark | |
| 2007/0084253 | A1 | 4/2007 | Ehrlich et al. | |
| 2007/0290065 | A1 | 12/2007 | Brown et al. | |
| 2010/0011607 | A1 | 1/2010 | Kim | |
| 2010/0071777 | A1 * | 3/2010 | Smith | D06F 39/022 137/14 |

(Continued)

FOREIGN PATENT DOCUMENTS

| | | |
|---|---|---|
| CN | 101253104 B | 4/2011 |
| CN | 203828718 U | 9/2014 |

(Continued)

*Primary Examiner* — John P McCormack

(74) *Attorney, Agent, or Firm* — Dority & Manning, P.A.

(57) ABSTRACT

An additive supply system for a laundry appliance is provided. The laundry appliance includes a cabinet defining an interior volume and a drum rotatably mounted within the interior volume of the cabinet. The drum defines a chamber for the receipt of clothes. The additive supply system includes a container configured to be removably mounted in the cabinet at a front panel of the cabinet. The container is configured for receipt of an additive. The container is in fluid communication with the chamber to provide the additive from the container to the chamber.

16 Claims, 10 Drawing Sheets

(56) References Cited

U.S. PATENT DOCUMENTS

| | | | | |
|---|---|---|---|---|
| 2011/0154865 | A1* | 6/2011 | Lee | D06F 39/02 68/200 |
| 2016/0039583 | A1 | 2/2016 | Brown | |
| 2016/0264315 | A1 | 9/2016 | Downey et al. | |
| 2018/0044902 | A1 | 2/2018 | Geymer | |

FOREIGN PATENT DOCUMENTS

| | | | | |
|---|---|---|---|---|
| KR | 20100081256 | A | * | 7/2010 |
| KR | 101192192 | B1 | | 10/2012 |

* cited by examiner

REMOVABLE ADDITIVE CONTAINER FOR LAUNDRY APPLIANCES

FIELD OF THE INVENTION

The present subject matter relates generally to laundry appliances, such as washing machine appliances and dryer appliances, and more particularly to laundry appliances that utilize a reservoir for providing additives to a load within the laundry appliances.

BACKGROUND OF THE INVENTION

Laundry appliances, such as washing machine appliances, dryer appliances, and washer/dryer combination appliances, generally include a cabinet and a drum (sometimes referred to as a basket, e.g., in the case of a washing machine appliance) rotatably mounted within the cabinet and defining a chamber for the receipt of articles for washing and/or drying. For example, a conventional appliance for drying articles such as a clothes dryer (or laundry dryer) for drying clothing articles typically includes a cabinet having a rotating drum for tumbling clothes and laundry articles therein. As another example, a conventional washing machine appliance typically includes a rotatable wash basket or drum which spins within a wash tub during operation of the appliance to agitate articles within the chamber, to wring wash fluid from articles within the chamber, etc.

In certain situations, it may be desirable to provide one or more additives to the clothes within the drum. For instance, additives may be provided to reduce wrinkling, to improve the scent of the clothes, and/or other fabric treatment additives such as fabric softener may be provided. Also by way of example, washing machine appliances can use a variety of fluid additives (in addition to water) to assist with washing and rinsing a load of articles. For example, detergents and/or stain removers may be added during wash and prewash cycles of washing machine appliances. As another example, fabric softeners may be added during rinse cycles of washing machine appliances. As additional examples, a user may prefer more fragrant clothes, or the laundry may have been sitting in the drum for an extended period and may smell slightly stale or musty. Conventional means of providing additives include systems for automatically dispensing detergent and/or fabric softener or manually placing dryer sheets or other additives within the drum prior to activation of the laundry appliance. Alternatively, clothes may be washed and dried again, resulting in excessive energy and water usage.

Accordingly, a laundry appliance having improved features for storing an additive and selectively providing the additive to the drum would be advantageous. In particular, a laundry appliance that includes features for readily accessing a container of additive, e.g., to fill, clean, and/or replace the container would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a laundry appliance is provided. The laundry appliance defines a vertical direction, a lateral direction, and a transverse direction. The vertical, lateral, and transverse directions are mutually perpendicular. The laundry appliance includes a cabinet extending along the transverse direction from a rear panel to a front panel, along the lateral direction from a left side panel to a right side panel, and along the vertical direction from a bottom panel to a top cover. The cabinet defines an interior volume. A drum is rotatably mounted within the interior volume of the cabinet. The drum defines a chamber for the receipt of clothes. A container is removably mounted in the cabinet at the front panel of the cabinet. The container is configured for receipt of an additive. The container is in fluid communication with the chamber to provide the additive from the container to the chamber.

In another aspect of the present disclosure, an additive supply system for a laundry appliance is provided. The laundry appliance includes a cabinet defining an interior volume and a drum rotatably mounted within the interior volume of the cabinet. The drum defines a chamber for the receipt of clothes. The additive supply system includes a container configured to be removably mounted in the cabinet at a front panel of the cabinet. The container is configured for receipt of an additive. The container is configured for fluid communication with the chamber to provide the additive from the container to the chamber when the container is mounted in the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
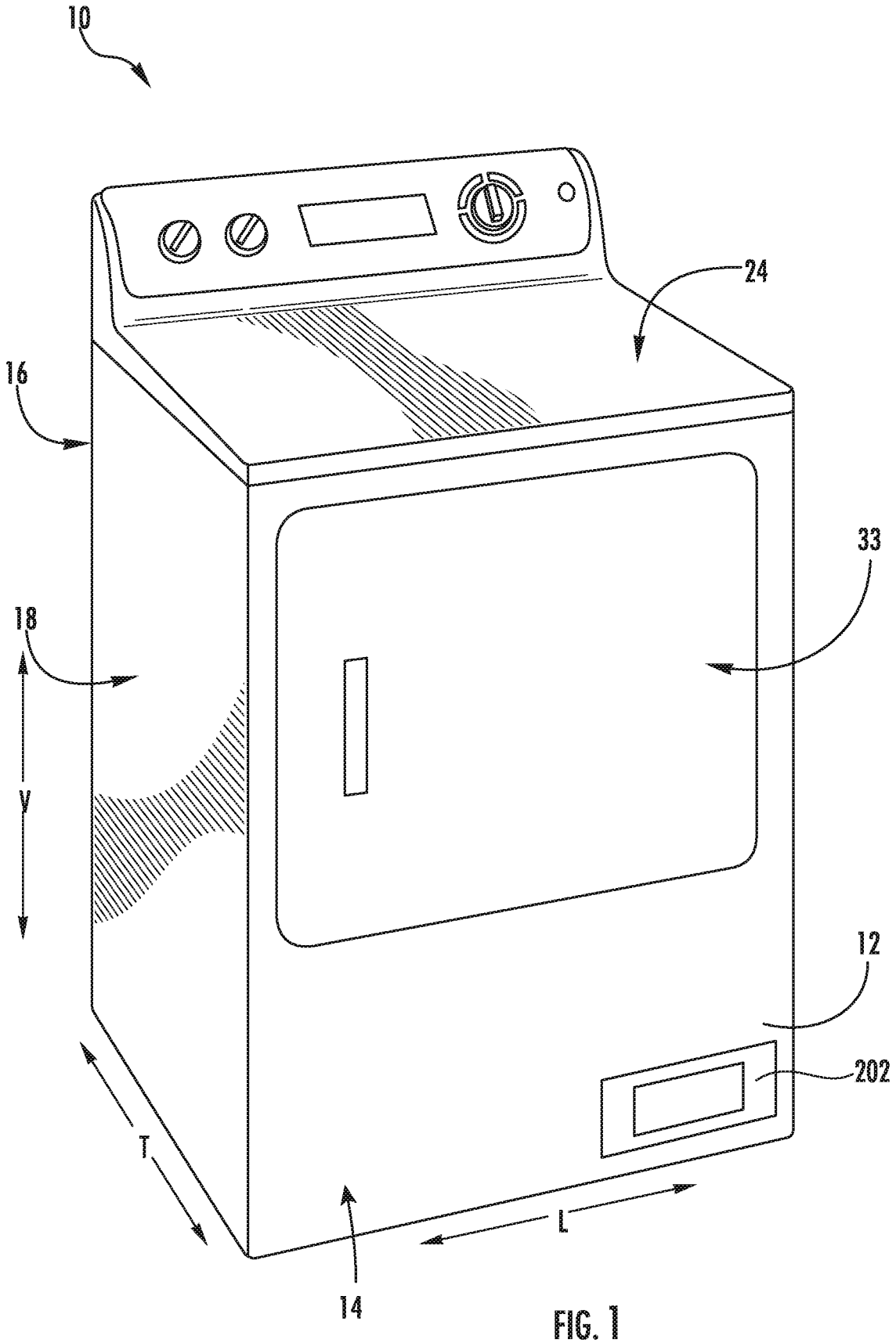
FIG. 1 provides a perspective view of a dryer appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
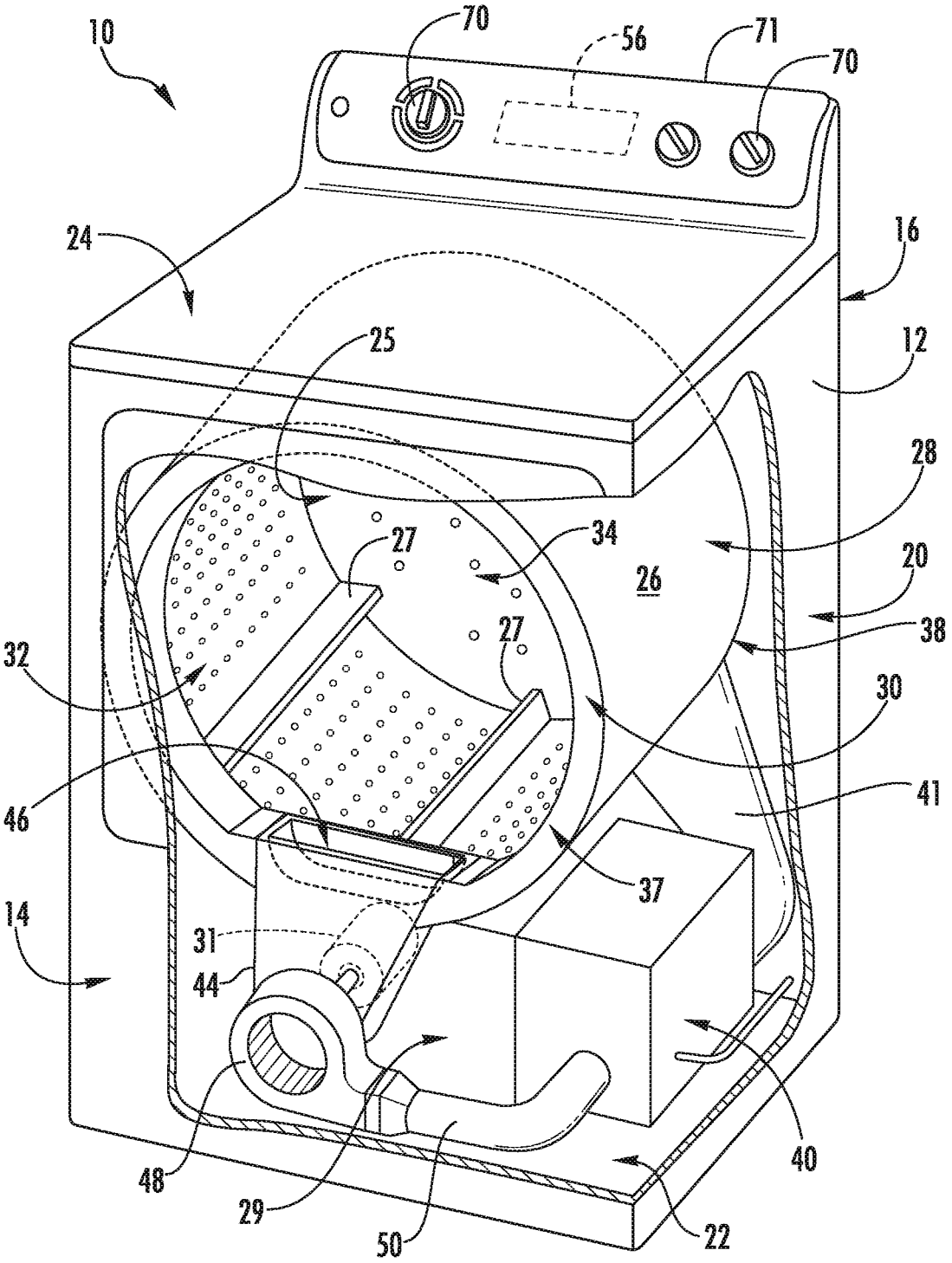
FIG. 2 provides a perspective view of the example dryer appliance of FIG. 1 with portions of a cabinet of the dryer appliance removed to reveal certain components of the dryer appliance.

Turning now to the figures, FIG. 1 provides a perspective view of a dryer appliance 10 which is an example of a laundry appliance according to exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other laundry appliances having different appearances and different features may also be utilized with the present subject matter as well. For example, the additive supply system 200 described herein may be provided in a vertical axis dryer appliance, a washing machine appliance, a combination washer/dryer appliance, or other laundry appliances.

Cabinet 12 includes a front panel 14, a rear panel 16, a left side panel 18 and a right side panel 20 spaced apart from each other by front and rear panels 14 and 16, a bottom panel 22, and a top cover 24. As used herein, terms such as "left" and "right" or "front" and "back" refer to from the perspective of a user facing the laundry appliance (e.g., dryer appliance 10) for accessing and/or operating the laundry appliance. For example, a user stands in front of the dryer appliance 10, e.g., at or near the front panel 14, to access door 33 and/or inputs 70 (the door 33 and inputs 70 are described in more detail below). Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receive heated air that has been heated by a heating assembly or system 40.

Figure 3:
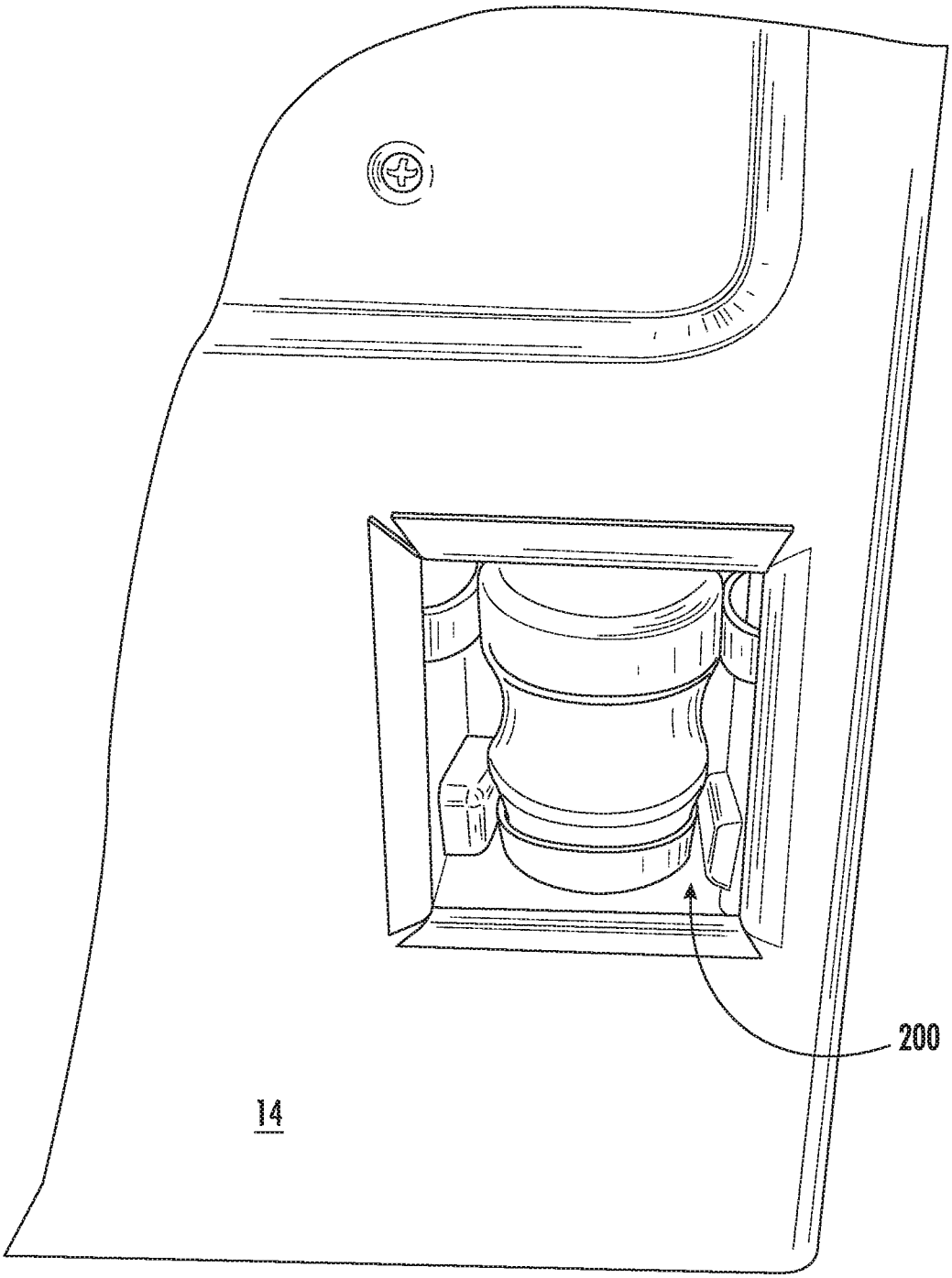
FIG. 3 provides an enlarged view of a portion of a front panel of the dryer appliance according to one or more exemplary embodiments of the present disclosure.

As shown in FIG. 1, a door 202 may be provided in the front panel 14 to provide selective access to an additive supply system 200 (e.g., FIG. 3). In various embodiments, the door 202 may be provided in or near a lower corner of the front panel 14. For example, in the illustrated embodiment of FIG. 1, the door 202 is positioned in a lower right corner of the front panel 14.

As used herein, the terms "clothing" or "clothes" includes but need not be limited to fabrics, textiles, garments, linens, papers, or other items. Furthermore, the term "load" or "laundry load" refers to the combination of clothing that may be washed together in a washing machine appliance or dried together in a dryer appliance and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. In various embodiments, rear wall 34 can be fixed or can be rotatable. Rear wall 34 may include, for instance, a plurality of holes that receive hot air that has been heated by a heating system 40, which may include, e.g., a resistance heating element, a gas burner, and/or a heat pump. Moisture laden, heated air is drawn from drum 26 by an air handler, such as blower fan 48, which generates a negative air pressure within drum. The air passes through a duct 44 enclosing screen filter 46, which traps lint particles. As the air passes from blower fan 48, it enters a duct 50 and then is passed into heating system 40. Heated air (with a lower moisture content than was received from drum 26), exits heating system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are in operable communication (e.g., electrically coupled or coupled through a wireless network band) with a processing device or controller 56. Controller 56 may also be provided in operable communication with motor 31, blower 48, and/or heating system 40. In turn, signals generated in controller 56 direct operation of motor 31, blower 48, or heating system 40 in response to the position of inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations.

FIG. 3 provides an enlarged view of a portion of a front panel of a laundry appliance according to one or more exemplary embodiments, e.g., the front panel 14 of the dryer appliance 10, with the door 202 removed to illustrate the additive supply system 200, which will be described in more detail below, removably mounted in the cabinet 12 at the front panel 14. In the particular example embodiment illustrated in FIGS. 1 and 3, the door 202 (FIG. 1) and the additive supply system 200 (FIG. 3) may be located in or near a lower right corner of the front panel 14. In other embodiments, for example as illustrated in FIG. 4 and described below, the door 202 may be located in or near a lower left corner of the front panel 14.

Figure 4:
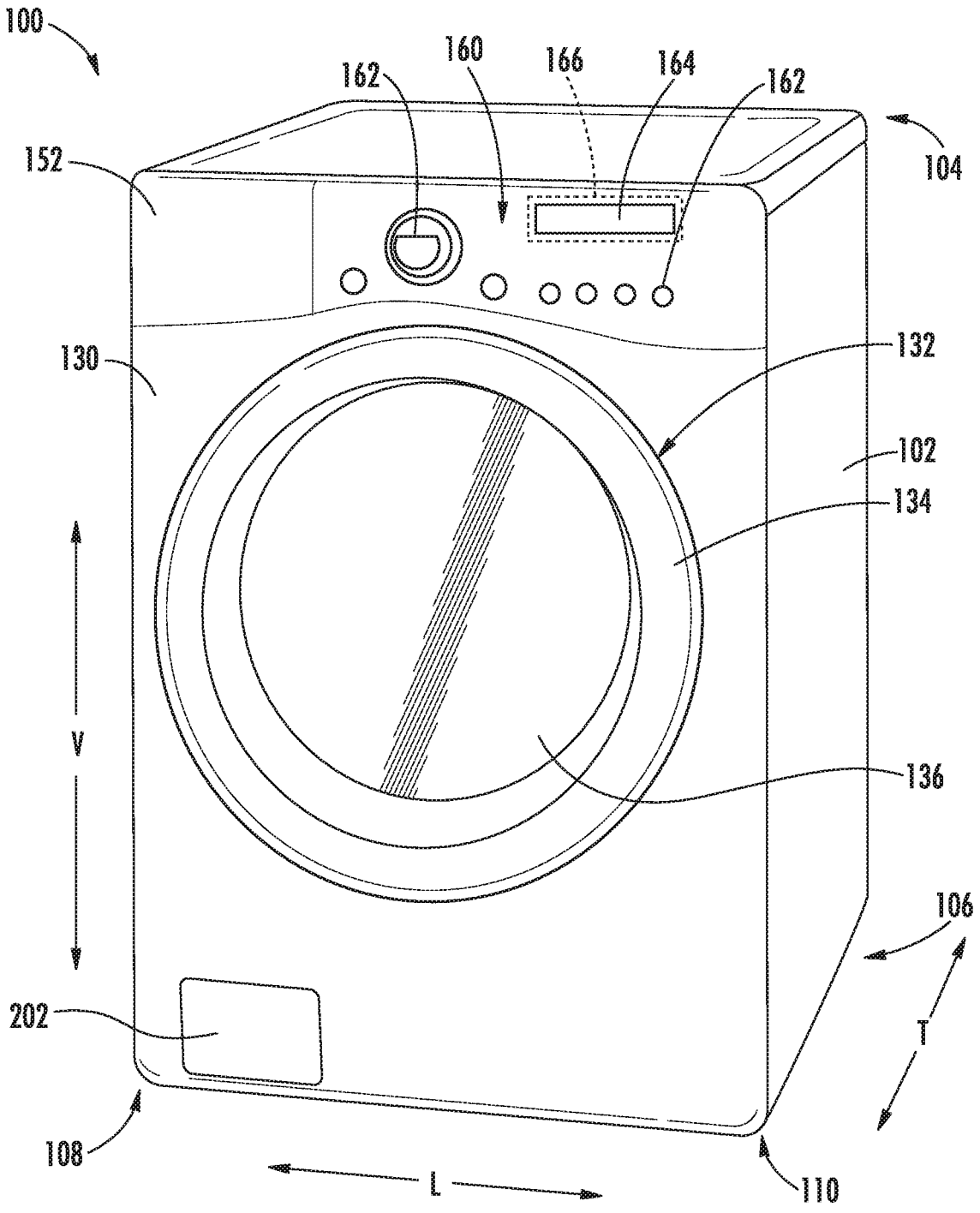
FIG. 4 provides a perspective view of a washing machine appliance according to one or more exemplary embodiments of the present subject matter.
Figure 5:
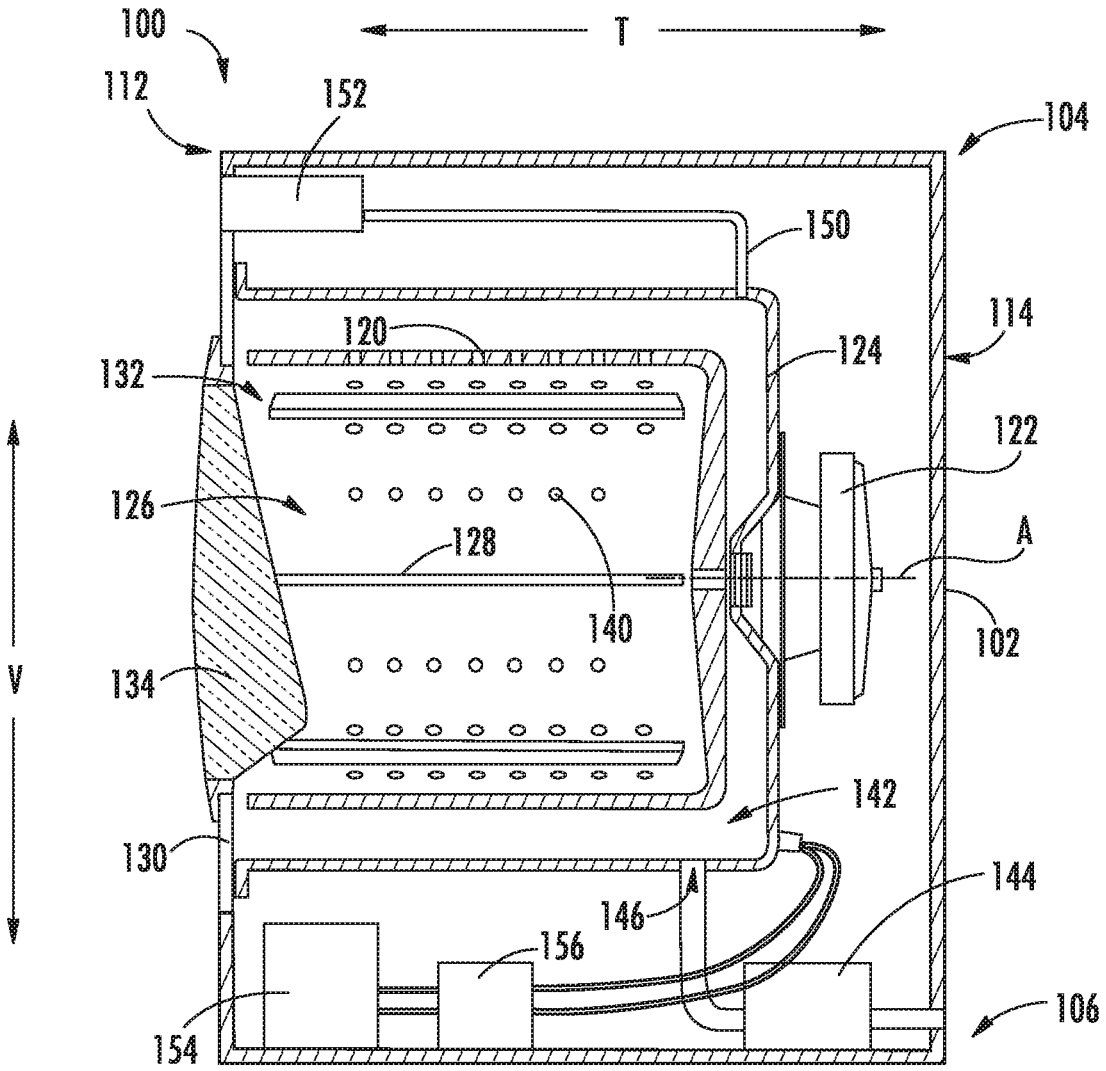
FIG. 5 provides a side cross-sectional view of the exemplary washing machine appliance of FIG. 4.

Referring now to FIGS. 4 and 5, another example laundry appliance is illustrated. FIG. 4 is a perspective view of an exemplary washing machine appliance 100 and FIG. 5 is a side cross-sectional view of the washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 (FIG. 5) and a rear 114 (FIG. 5) along the transverse direction T.

As may be seen in FIG. 5, a wash tub 124 is non-rotatably mounted within cabinet 102. The wash tub 124 defines a central axis A. In the example embodiment illustrated by FIG. 5, the central axis A may be oriented generally along or parallel to the transverse direction T of the washing machine appliance 100. Accordingly, the washing machine appliance 100 may be referred to as a horizontal axis washing machine.

Still referring to FIG. 5, in some embodiments, the drum may be a wash basket 120 rotatably mounted within the tub 124 such that the wash basket 120 is rotatable about an axis of rotation, which generally coincides with central axis A of the tub 124. A motor 122, e.g., such as a pancake motor, is in mechanical communication with wash basket 120 to selectively rotate wash basket 120 (e.g., during an agitation or a rinse cycle of washing machine appliance 100). Wash basket 120 defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. The wash basket 120 and the tub 124 may collectively define at least a portion of a tub assembly for the washing machine appliance 100.

Wash basket 120 may define one or more agitator features that extend into wash chamber 126 to assist in agitation and cleaning of articles disposed within wash chamber 126 during operation of washing machine appliance 100. For example, as illustrated in FIG. 5, a plurality of ribs 128 extends from basket 120 into wash chamber 126. In this manner, for example, ribs 128 may lift articles disposed in wash basket 120 during rotation of wash basket 120.

Referring generally to FIGS. 4 and 5, cabinet 102 also includes a front panel 130 which defines an opening 132 that permits user access to wash basket 120 within wash tub 124. More specifically, washing machine appliance 100 includes a door 134 that is positioned in front of opening 132 and is rotatably mounted to front panel 130. Door 134 is rotatable such that door 134 permits selective access to opening 132 by rotating between an open position (not shown) facilitating access to a wash tub 124 and a closed position (FIG. 4) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Figure 6:
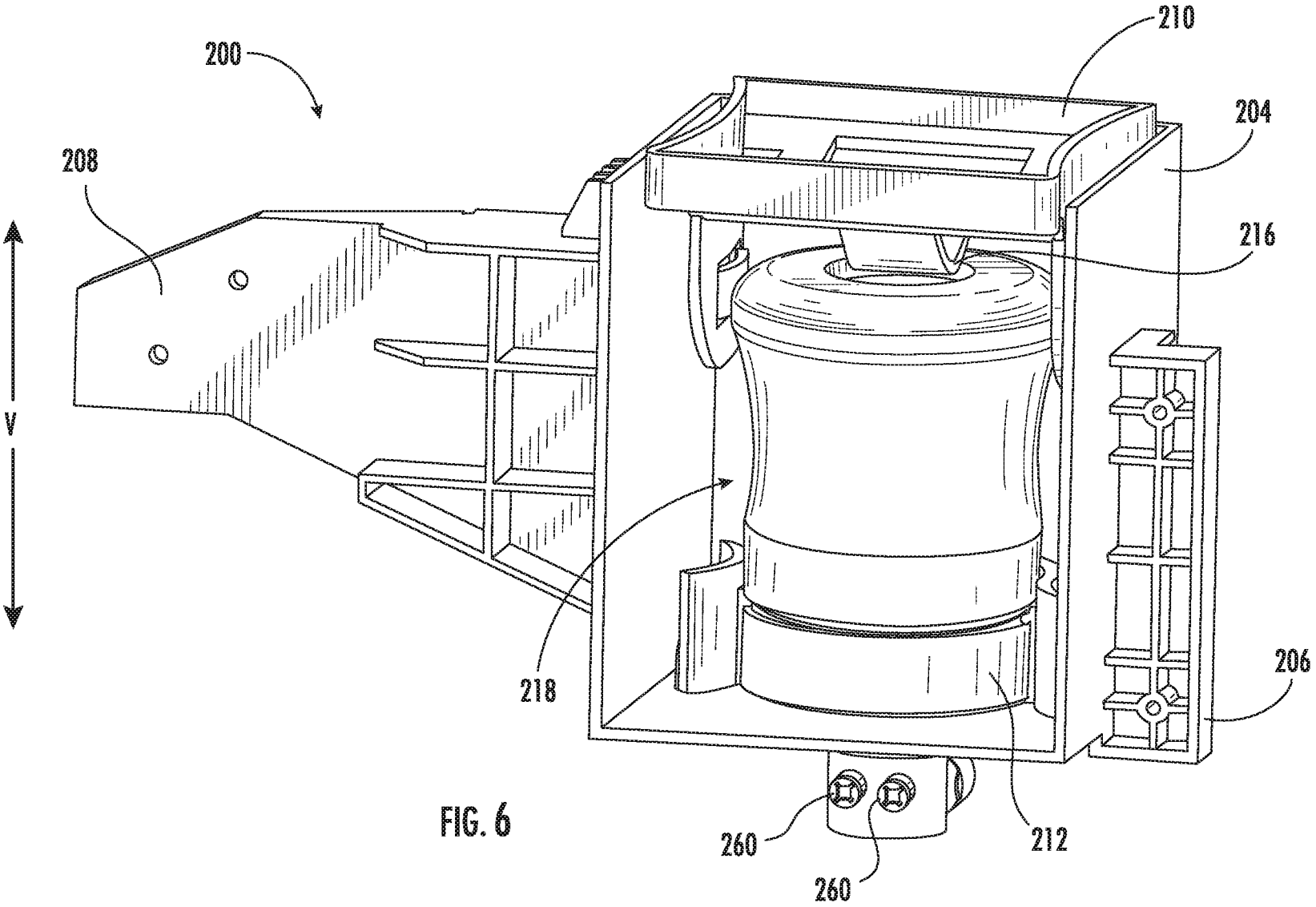
FIG. 6 provides a perspective view of an additive supply system for a laundry appliance such as the dryer appliance of FIGS. 1-3 or the washing machine appliance of FIGS. 4-5 according to one or more exemplary embodiments of the present disclosure.

Also shown in FIG. 4 is a door 202 in the front panel 130 providing selective access to the additive supply system 200 (e.g., FIGS. 3 and 6). In this exemplary embodiment, the door 202 is positioned in a lower left corner of the front panel 130.

Referring again to FIG. 5, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140. A pump assembly 144 is located beneath tub 124 for gravity assisted flow when draining tub 124, e.g., via a drain 146. Pump assembly 144 may be configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated in FIG. 5, a detergent drawer 152 is slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

Optionally, a bulk reservoir 154 may be disposed within cabinet 102. Bulk reservoir 154 is also configured for receipt of fluid additive for use during operation of washing machine appliance 100. Bulk reservoir 154 is sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 4) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 150 and/or detergent drawer 152. One or more valves (not shown) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a spin cycle, basket 120 is rotated at relatively high speeds. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other laundry appliances having different configurations, different appearances, and/or different features may also be utilized with the present subject matter as well, e.g., vertical axis washing machine appliances or other laundry appliances.

Referring now to FIG. 6, a system 200 for introducing an additive into chamber 25 (FIG. 2) or chamber 126 (FIG. 5), and thus the clothes therein, will be described according to an exemplary embodiment of the present subject matter. For example, the additive supply system 200 may be in fluid communication with one or more spray nozzles (not shown) which are positioned and arranged to provide a spray of additive from the additive supply system 200 into the chamber 25 or 126, such as onto clothing articles therein. The additive supply system 200 may advantageously be visible and accessible from the front of the laundry appliance, such as via the door 202 in the front panel 14 (FIG. 1) or 130 (FIG. 4).

As shown in FIG. 6, the additive supply system 200 may include an enclosure 204. The enclosure 204 maybe mountable within the cabinet 12 or 102 via a first mounting flange 206 and a second mounting flange 208. A top guide 210 and a bottom guide 212 may be fixedly connected to the enclosure 204. A container 218 may be received within the enclosure 204 between the top guide 210 and the bottom guide 212 along the vertical direction V. The top guide 210 may include a clip 216, e.g., a leaf spring, which removably retains the container 218 within the enclosure 204. For example, the clip 216 may be received in a recess 232 (FIG. 7) in a bottle 220 of the container 218. Where the enclosure 204 is mounted within the cabinet 12 or 102 of the laundry appliance 10 or 100, the container 218 is removably mounted in the cabinet 12 or 102 when the container 218 is received within the enclosure 204 as illustrated in FIG. 6. For example, as illustrated in FIGS. 1 and 5, the enclosure 204 of the additive supply system 200 may be mounted behind the door 202 in the front panel 14 or 130, such that the container 218 is removably mounted in the cabinet 12 or 102 at the front panel 14 or 130 of the cabinet 12 or 102 when the container 218 is received within the enclosure 204.

The container 218 may be configured for receipt of an additive. For example, as may be seen in FIG. 7, the container 218 may include a bottle 220 and a cap 222. The bottle 220 may be configured for receipt and storage of an additive, e.g., within an internal volume 224 (FIGS. 9 and 10) of the bottle 220. The cap 222 may be removably connected to an open end 226 of the bottle 220 to selectively enclose the internal volume 224 of the bottle 220. For example, the cap 222 may be threadedly connected to the open end 226 of the bottle 220. For example, the bottle 220 may include an external thread 228 and the cap 222 may include an internal thread 230 configured to engage the external thread 228 of the bottle 220. The cap 222 may include an outlet 234 which permits fluid flow from the bottle 220 when the container 218 is oriented such that cap 222 is positioned below the bottle 220. For example, when the cap 222 is connected to the bottle 220, the internal volume 224 of the bottle 220 may thereby be enclosed such that additive within the internal volume 224 is prevented or obstructed from flowing out of the bottle 220 other than via the outlet 234. For example, when the bottle 220 is upside down, e.g., with the open end 226 positioned or oriented downward along the vertical direction V, any additive within the internal volume 224 may tend to flow out of the bottle 220 at the open end 226, however, with the cap 222 screwed onto the bottle 220, the additive is generally prevented from flowing out of the bottle 220 by the cap 222.

Figure 7:
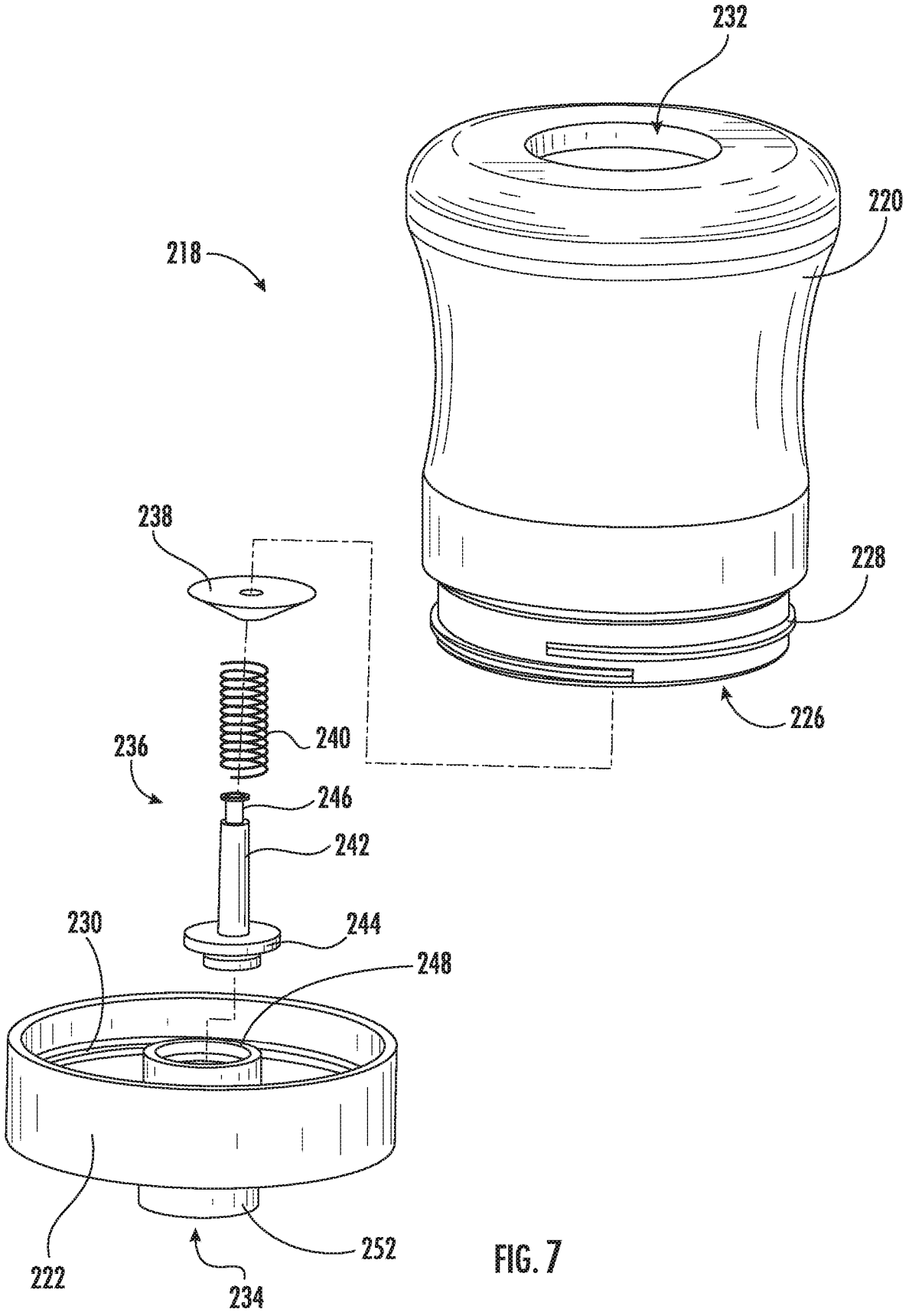
FIG. 7 provides an exploded view of certain components of the additive supply system of FIG. 6.

In particular, a valve 236 may be positioned in or at the outlet 234 of the cap 222 to prevent or inhibit additive flow when the valve 236 is in a closed position. For example, the valve 236 may include a gasket or seal 238, e.g., a frusto-conical seal 238 as illustrated in FIG. 7. The seal 238 may sealingly engage a rim 248 in the cap 222 upstream of the outlet 234 to prevent or inhibit fluid, e.g., additive, flow through the outlet 234. For example, the rim 248 may be directly upstream of the outlet 234. For example, the rim 248 may be integrally formed with the outlet 234, e.g., the rim 248 and the outlet 234 may be disposed at opposite ends of a single spout or conduit 252 in the cap 222. The valve 236 may further include a biasing element, such as a coil spring 240, configured to bias the valve 236 to the closed position, e.g., to bias the seal 238 against the rim 248 and into sealing engagement with the rim 248. The valve 236 may be a pin valve or piston valve, e.g., the valve 236 may include a piston 242 extending from a flange 244 at a first end of the piston 242 to a recess 246 at a second end of the piston 242 opposing the first end of the piston 242. As may be seen in FIG. 9, the seal 238 may be mounted on the second end of the piston 242 via the recess 246. The coil spring 240 may extend between and bias against each of the flange 244 of the piston 242 and one or more ribs 250 (FIG. 9) within the conduit 252. For example, the ribs 250 may be positioned at or proximate the rim 248 of the conduit 252.

Figure 8:
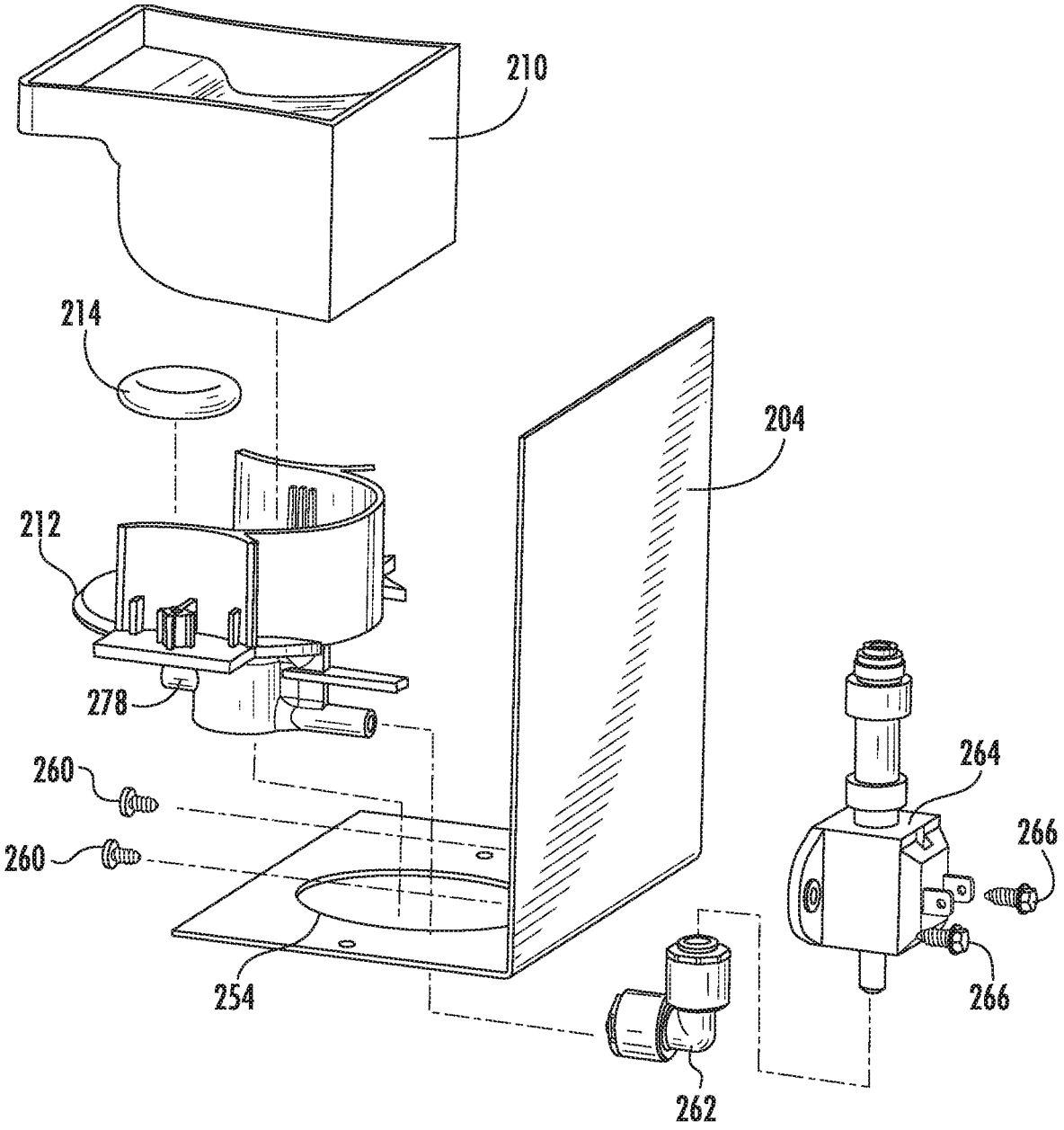
FIG. 8 provides an exploded view of additional components of the additive supply system of FIG. 6.
Figure 9:
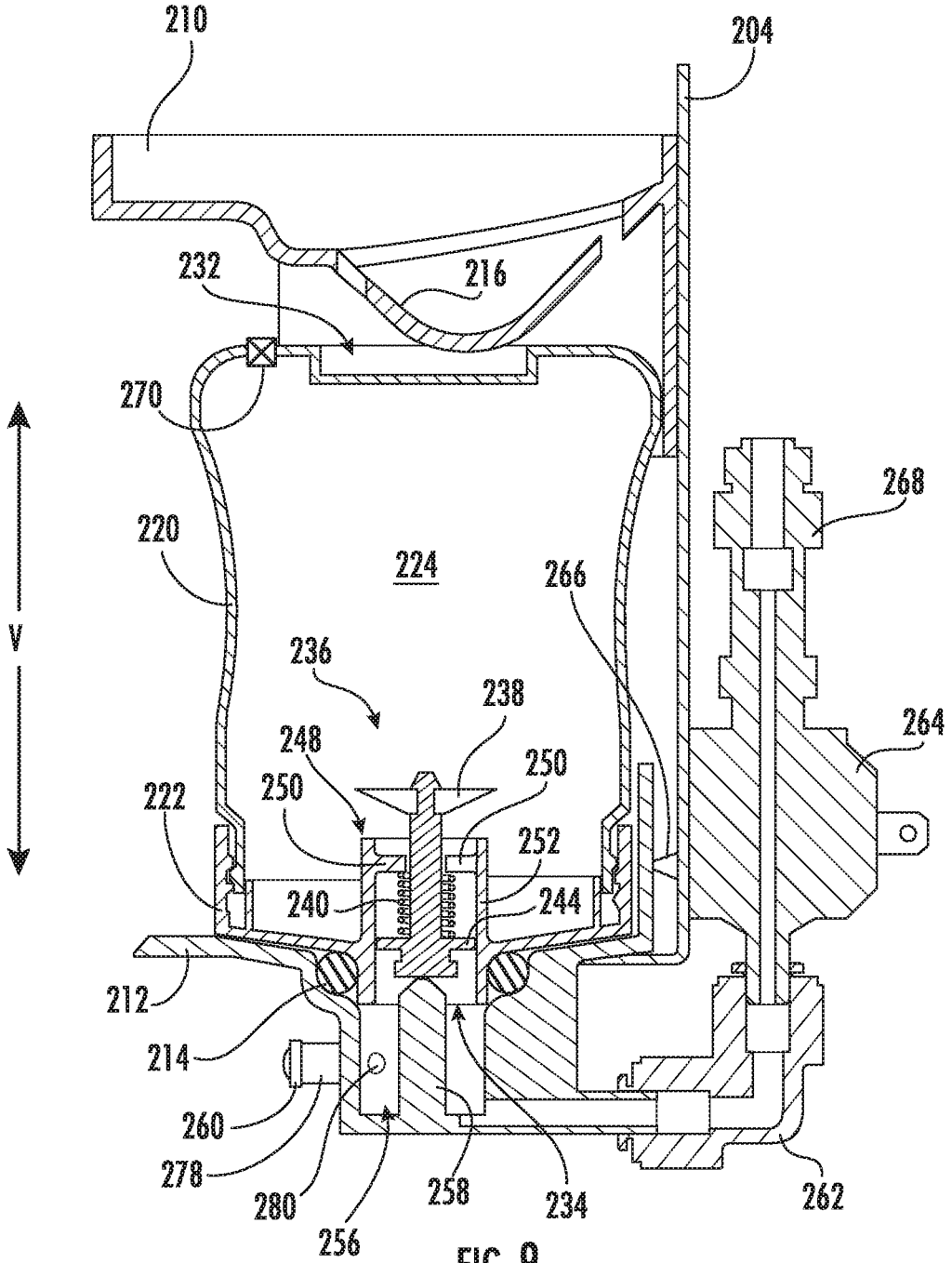
FIG. 9 provides a section view of the additive supply system of FIG. 6.
Figure 10:
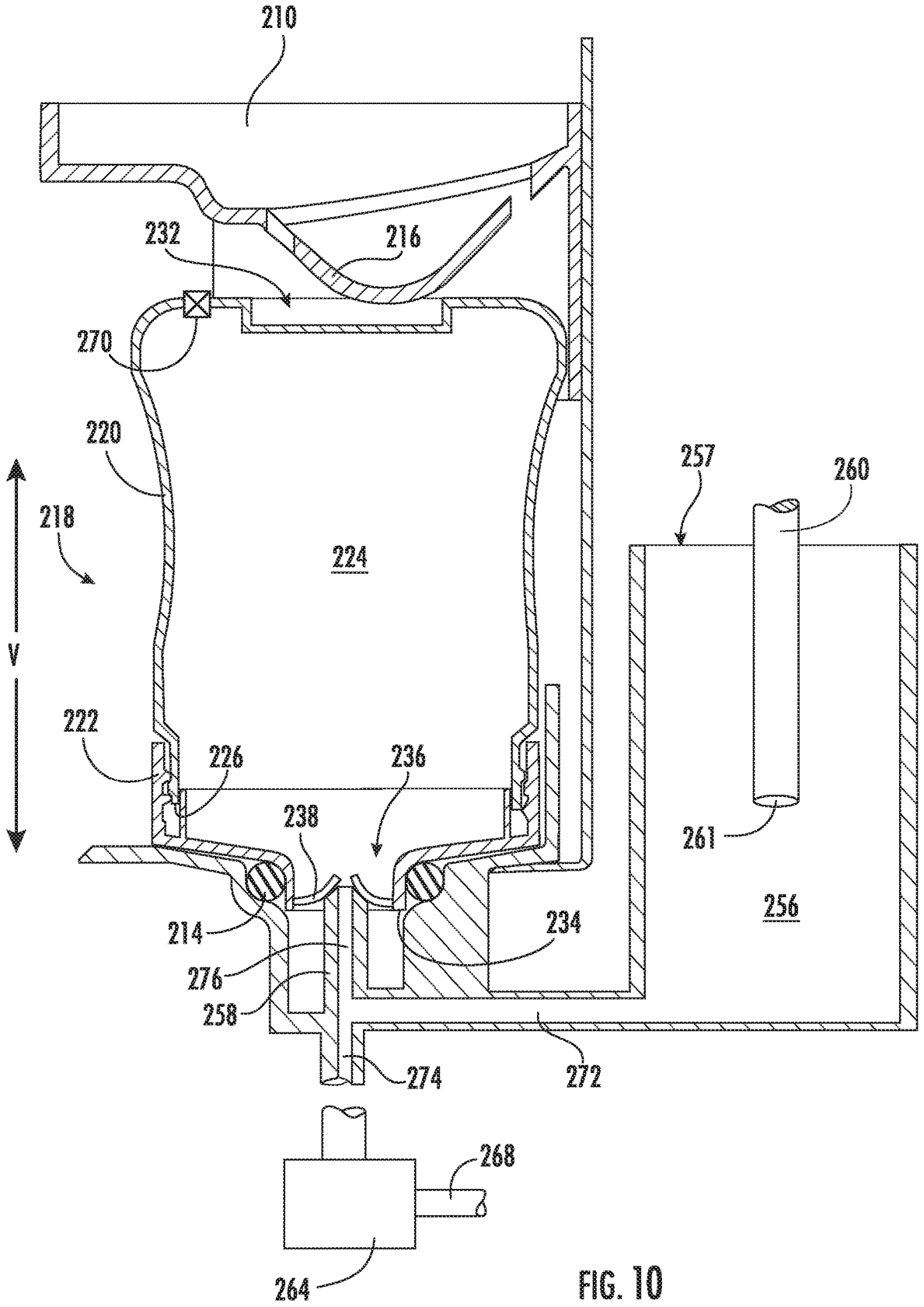
FIG. 10 provides a section view of an additive supply system for a laundry appliance such as the dryer appliance of FIGS. 1-3 or the washing machine appliance of FIGS. 4-5 according to one or more additional exemplary embodiments of the present disclosure.

Referring now to FIG. 8, additional components of the additive supply system 200 are illustrated in an exploded view. As shown in FIG. 8, the enclosure 204 of the additive supply system 200 may include an aperture 254 into which the bottom guide 212 may be received. The additive supply system 200 may also include a gasket, e.g., an O-ring 214 positioned in the bottom guide 212 to sealingly engage the bottom guide 212 and the cap 222 of the container 218, e.g., when the cap 222 is received, or at least partially received, in the bottom guide 212, e.g., as illustrated in FIG. 9. In particular, as seen in FIGS. 9 and 10, the O-ring 214 may sealingly engage the outlet 234 and the bottom guide 212. The additive supply system 200 may also include one or more pressure rods 260, such as the screw pressure rods 260 illustrated in FIG. 8, which are described in more detail below. A pump 264 may be provided, and may in some embodiments such as the example embodiment illustrated in FIGS. 8 and 9 be connected to the bottom guide 212 by a fitting such as an elbow fitting 262. Such connection between the bottom guide 212 and the pump 264 may be a pressure connection, e.g., a pressure-tight or pressure-resistant connection, whereby the pump 264 may draw additive from the container 218 by pressure. The pump 264 may be connected to or mounted on the enclosure 204 with fasteners, such as screws 266 as illustrated in FIG. 8.

Turning now to FIG. 9, the bottom guide 212 may include a reservoir 256 defined therein. The reservoir 256 of the bottom guide 212 may be in fluid communication with the container 218, e.g., with the bottle 220 of the container 218 when the container 218 is mounted between the top guide 210 and the bottom guide 212. For example, the reservoir 256 may be downstream of the container 218, e.g., such that additive from the bottle 220 may flow into the reservoir 256 from the bottle 220 when the valve 236 is in the open position, e.g., as shown in FIGS. 9 and 10. The valve 236 may be opened by a pin 258 in the bottom guide 212. In one example, as illustrated in FIG. 9, the pin 258 may be positioned in the reservoir 256 such that the pin 258 engages the piston 242 of the valve 236 when the container 218, e.g., the cap 222 thereof, is inserted into the bottom guide 212. Thus, the pin 258 may push the piston 242 away from the outlet 234, e.g., upwards along the vertical direction V, such that the seal 238 mounted on the piston 242 is unseated and disengaged from the rim 248 of the conduit 252. In this position, e.g., the open position of the valve 236, additive may flow from the bottle 220, e.g., from the internal volume 224 thereof, into the bottom guide 212, e.g., into the reservoir 256 in the bottom guide 212.

In various embodiments, the pressure rod or rods 260 may be in operative communication with the reservoir 256 to measure a pressure of additive in the reservoir 256. For example, the measured pressure of the additive in the reservoir 256 may correspond to or indicate a fill level of additive in the reservoir. In one exemplary embodiment, e.g., as illustrated in FIG. 9, the pressure rods 260 may be screw pressure rods 260, as mentioned above with respect to FIG. 8, and the screw pressure rods 260 may be mounted, e.g., threaded, into posts 278. The posts 278 may be hollow and may define an internal conduit, e.g., to receive the pressure rods 260 therein. Also, the hollow posts 278 may open into an aperture 280 in the reservoir 256. Accordingly, the pressure rods 260 may be in operative communication with the reservoir 256 through the aperture 280 and the posts 278 to measure a pressure of additive in the reservoir 256.

Also shown in FIG. 9 is pump 264 which is connected to the reservoir 256 through a fitting 262, e.g., an elbow fitting 262, as illustrated in FIG. 9. Thus, the pump 264 may be in fluid communication with the reservoir 256, e.g., via the elbow fitting 262, such that the pump may be operable to draw additive from the reservoir 256. Additionally, the pump 264 may include an outlet 268 and the outlet 268 may be in fluid communication with the drum 26 (FIG. 2) or 120 (FIG. 5), e.g., the outlet 268 may be connected to a spray nozzle, spout, or other fluid delivery means by one or more conduits, tubes, etc., to supply additive from the pump 264 to the drum 26 or 120 via the fluid delivery means. Thus, the pump 264 may be operable to provide the additive from the reservoir 256 to the chamber 25 or 126. As mentioned above, the connection between the bottom guide 212 and the pump 264 through the fitting 262 may be a pressure connection, e.g., a pressure-tight or pressure-resistant connection, whereby the pump 264 may draw additive from the container 218 by pressure. For example, in embodiments such as in FIG. 9, the pump 264 may be a vacuum pump 264 and the reservoir 256 and the pump 264 may be in fluid communication via a pressure connection such that the pump 264 is operable to draw the additive from the reservoir 256 under vacuum pressure. In various embodiments, the bottle 220 may also include a vent 270, e.g., a one-way valve 270, such as a duckbill valve, as depicted schematically in FIGS. 9 and 10 which permits air flow into the internal volume 224 of the bottle 220 from an ambient environment (which may, in at least some embodiments, be the interior of the laundry appliance 10 or 100, such as the interior volume 29 illustrated in FIG. 2), to prevent or reduce a vacuum above the additive within the internal volume 224 of the bottle 220.

FIG. 10 illustrates another exemplary embodiment of the additive supply system 200. As shown in FIG. 10, in some embodiments, the reservoir 256 may be open to atmospheric pressure in the ambient environment, e.g., at a top end 257 of the reservoir 256. In such embodiments, the pump 264 may be positioned below the reservoir 256 along the vertical direction V, such that the additive may flow from the container 218 to the pump 264 by gravity. For example, as illustrated in FIG. 10, the reservoir 256 of the bottom guide 212 may be spaced apart from the outlet 234 of the container 218 and the container 218 and the reservoir 256 may be in fluid communication through a first conduit 272. In such embodiments, the additive supply system 200 may also include a second conduit 274 extending between the outlet 234 and the pump 264.

In some embodiments, such as the exemplary embodiment illustrated in FIG. 10, a single pressure rod 260 may be provided. As mentioned above, the pressure rod 260 may be in operative communication with the reservoir 256 to measure a pressure of additive in the reservoir 256. For example, the measured pressure of the additive in the reservoir 256 may correspond to or indicate a fill level of additive in the reservoir. In embodiments such as the example shown in FIG. 10 where the reservoir 256 is open to atmospheric pressure and the internal volume 224 of the bottle 220 is also under atmospheric pressure (e.g., via the vent 270, as discussed above), the additive may flow from the bottle 220 to the reservoir 256 such that a fill level of the additive in the bottle 220 is at or about the same level as a fill level of additive in the reservoir 256. As shown in FIG. 10, the pressure rod 260 may extend along the vertical direction V such that a lower end 261 of the pressure rod 260 is generally aligned with the open end 226 of the bottle 220, e.g., the lower end 261 of the pressure rod 260 may be at or about the same vertical position as the open end 226 of the bottle 220. Accordingly, the pressure rod 260 may sense or detect a fill level of additive in the bottle 200, e.g., when the pressure rod 260 detects the presence of additive due to the fluid pressure of the additive on the pressure rod 260 within the reservoir 256, it may be determined that the bottle 220 is not empty, whereas when the pressure rod 260 does not detect the presence of additive within the reservoir 256, e.g., when the fill level of additive in the reservoir 256 is below the lower end 261 of the pressure rod 260, it may be determined that the bottle 220 is generally empty of additive, e.g., that the level of additive is below the open end 226 of the bottle 200, e.g., along the vertical direction V as depicted in FIG. 10. In such instances, a user notification may be provided to indicate a need to remove, refill, and reinstall the container 218.

In some embodiments, for example as illustrated in FIG. 10, the valve 236 may be a flexible valve including a flexible seal 238 which is opened or unsealed by the pin 258. For example, the flexible seal 238 may include a continuous membrane across the outlet 234 which is formed of a resilient material such as an elastomeric material with one or more slits in the membrane such that, when the container 218 is inserted into the bottom guide 212, the pin 258 pushes apart the two or more sections of the membrane or seal 238 defined on opposing sides of the one or more slits in the seal 238, thereby permitting fluid, e.g., additive, flow from the internal volume 224 of the bottle 220. In such embodiments, the pin 258 in the bottom guide 212 may include a third conduit 276 defined therein. Thus, when the flexible valve 236 is in an open position as illustrated in FIG. 10, additive may flow from the internal volume 224 of the bottle 220 through the third conduit 276 in the pin 258.

In various embodiments, additive may be supplied only when a specific set of operating parameters exist, e.g., in embodiments where the laundry appliance is a dryer appliance 10, when heating system 40 is off and drum 26 is spinning. For example, supplying additive when the heating system 40 is off may occur immediately after a drying cycle, or following a short delay, e.g., a few seconds, after a drying cycle. As such, clothes within the chamber 25 may still be warm, e.g., at an elevated temperature relative to room temperature, when the additive is sprayed into the chamber 25, which may promote or enhance the effects of certain additives such as fragrances. Rotation of the drum 26 while spraying the additive may promote even distribution of the additive on clothes within the chamber 25, and in some cases may provide additional benefits. For example, when the additive includes a wrinkle releaser, agitation of the clothes due to rotation of the basket 26 may increase effectiveness of the wrinkle releaser. In some embodiments, the additive may be supplied in response to a user selection, which may be selected via one or more of the inputs 70 or 162. For example, a dedicated "refresh" cycle and/or "add scent" option for one or more standard laundry appliance cycles may be provided.

The additive supply system 200 and removable additive container 218 provide several advantages over previous systems, as will be recognized by those of skill in the art. For example, the container 218 may be conveniently accessed via the door 202. As another example, the container 218 may be easily disassembled, e.g., the bottle 220 and cap 222 may be easily separated such as by unscrewing, to allow a user to rinse the container 218, to refill the container 218 with any desired additive, etc. As an additional example, where the container 218 is removable, as user may be permitted to easily carry the container 218 to another location, such as a sink, e.g., in a laundry room or kitchen, for cleaning or a storage location where replacement additive may be stored for refilling. As a further example, the container 218 is generally spill-proof or spill resistant, such that when the user returns the container 218 to the laundry appliance 10 or 100 after refilling the container 218 at the other location (e.g., away from the laundry appliance 10 or 100), the valve 236 may prevent or reduce undesired release of additive from the container 218, including when the container 218 is upright (e.g., with the cap 222 above the bottle 220) and when the container 218 is inverted (e.g., with the cap 222 below the bottle 220).

As noted above, features illustrated or described as part of one embodiment can be used with another embodiment to yield a still further embodiment. Thus, for example, the valve 236 which includes a piston 242 as illustrated in FIGS. 7 and 9 may be provided in the additive supply system 200 as illustrated in FIG. 10 instead of or in addition to the flexible valve 236. Numerous other example combinations and variations are also possible, as will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance defining a vertical direction, a lateral direction, and a transverse direction, the vertical, lateral, and transverse directions are mutually perpendicular, the laundry appliance comprising:

a cabinet extending along the transverse direction from a rear panel to a front panel, along the lateral direction from a left side panel to a right side panel, and along the vertical direction from a bottom panel to a top cover, the cabinet defining an interior volume;

a drum rotatably mounted within the interior volume of the cabinet, the drum defining a chamber for the receipt of clothes;

a container removably mounted in the cabinet at the front panel of the cabinet, the container configured for receipt of an additive and in fluid communication with the chamber to provide the additive from the container to the chamber, the container comprising a bottle and a cap, the cap comprising an outlet permitting fluid flow from the bottle when the container is oriented such that the cap is positioned below the bottle; and a bottom guide and a top guide within the cabinet, wherein the container is removably mounted in the cabinet retained by and positioned between the bottom guide and the top guide along the vertical direction with the cap at least partially received in the bottom guide.

2. The laundry appliance of claim 1, wherein the container further comprises a valve in the outlet which obstructs fluid flow from the bottle when the cap is positioned below the bottle.

3. The laundry appliance of claim 1, wherein the top guide comprises a clip and the bottle comprises a recess, the clip of the top guide configured to engage the recess in the bottle when the container is removably mounted in the cabinet.

4. The laundry appliance of claim 1, wherein the container further comprises a valve in the outlet which obstructs fluid flow from the bottle when the cap is positioned below the bottle and wherein the bottom guide comprises a pin which opens the valve when the container is removably mounted in the cabinet.

5. The laundry appliance of claim 1, wherein the bottom guide comprises a reservoir downstream of the container.

6. The laundry appliance of claim 5, further comprising a pressure rod in operative communication with the reservoir to measure a pressure of an additive in the reservoir.

7. The laundry appliance of claim 5, further comprising a pump in fluid communication with the reservoir, the pump operable to provide an additive from the reservoir to the chamber of the drum.

8. The laundry appliance of claim 7, wherein the pump is a vacuum pump and wherein the reservoir and the pump are in fluid communication via a pressure connection whereby the pump is operable to draw the additive from the reservoir under vacuum pressure.

9. The laundry appliance of claim 7, wherein the reservoir is open to atmospheric pressure and the pump is positioned below the reservoir along the vertical direction, whereby the additive flows to the pump under gravity.

10. An additive supply system for a laundry appliance, the laundry appliance comprising a cabinet defining an interior volume and a drum rotatably mounted within the interior volume of the cabinet, the drum defining a chamber for the receipt of clothes, the additive supply system comprising:

a container configured to be removably mounted in the cabinet at a front panel of the cabinet, the container configured for receipt of an additive and configured for fluid communication with the chamber to provide the additive from the container to the chamber when the container is removably mounted in the cabinet, wherein the container comprises a bottle, a cap, the cap comprising an outlet permitting fluid flow from the bottle when the container is oriented such that cap is positioned below the bottle, and a valve in the outlet which obstructs fluid flow from the bottle when the cap is positioned below the bottle; and a bottom guide and a top guide, wherein the container is configured to be retained by and removably mounted between the bottom guide and the top guide with the cap at least partially received in the bottom guide.

11. The additive supply system of claim 10, wherein the bottom guide comprises a pin which opens the valve when the container is removably mounted between the bottom guide and the top guide.

12. The additive supply system of claim 10, wherein the bottom guide comprises a reservoir downstream of the container.

13. The additive supply system of claim 12, further comprising a pressure rod in operative communication with the reservoir to measure a pressure of an additive in the reservoir.

14. The additive supply system of claim 10, further comprising a pump in fluid communication with the reservoir, the pump operable to provide an additive from the reservoir to the chamber of the drum.

15. The additive supply system of claim 14, wherein the pump is a vacuum pump and wherein the reservoir and the pump are in fluid communication via a pressure connection whereby the pump is operable to draw the additive from the reservoir under vacuum pressure.

16. The additive supply system of claim 14, wherein the reservoir is open to atmospheric pressure and the pump is positioned below the reservoir, whereby the additive flows to the pump under gravity.

* * * * *